US005328342A

United States Patent [19]

Ishii et al.

[11] Patent Number: 5,328,342

[45] Date of Patent: Jul. 12, 1994

[54] SCROLL COMPRESSOR WITH SLIDER CONTACTING AN ELASTIC MEMBER

[75] Inventors: Minoru Ishii; Masahiko Oide; Masahiro Sugihara, all of Tokyo; Masaaki Sugawa, Wakayama, all of Japan

[73] Assignee: Mitsubishi Denki Kabushiki Kaisha, Tokyo, Japan

[21] Appl. No.: 708

[22] Filed: Jan. 5, 1993

[30] Foreign Application Priority Data

Jan. 10, 1992 [JP] Japan ..... 4-002978

[51] Int. Cl.[5] ..... F04C 18/04

[52] U.S. Cl. ..... 418/55.5; 418/57

[58] Field of Search ..... 418/55.5, 57

[56] References Cited

U.S. PATENT DOCUMENTS 5,017,107 5/1991 Fraser, Jr. et al. ..... 418/55.5
5,040,958 8/1991 Arata et al. ..... 418/55.5

FOREIGN PATENT DOCUMENTS 3-57893 3/1991 Japan .
3-233178 10/1991 Japan .
3260386 11/1991 Japan ..... 418/55.5

*Primary Examiner*—John J. Vrablik
*Attorney, Agent, or Firm*—Oblon, Spivak, McClelland, Maier & Neustadt

[57] ABSTRACT

A scroll compressor features a pair of a fixed scroll and an orbiting scroll for forming a compression chamber; an orbiting bearing provided on the counter-compression chamber side of the orbiting scroll; a slider fitted to a slider fitting shaft at one end of a main shaft in such a way that the slider is slidable within a surface perpendicular to the axis of the main shaft, the slider being fitted in the orbiting bearing, a sliding direction of the slider is inclined toward the eccentric direction of the orbiting scroll by a predetermined amount in the rotational direction of the main shaft, in which a recess is provided on the groove end side in the eccentric direction of the slider. Further an elastic member is inserted in the recess between the groove end side in the eccentric direction and the slider fitting shaft while both ends of the plate are supported with respect to the recess. The slider fitting shaft is formed in an arcuate configuration as long as the contact surface between the flat plate and the slide fitting shaft is concerned, and the spiral bodies of the fixed scroll and the orbiting scroll both are made to radially contact each other in the eccentric and counter-eccentric directions of the orbiting scroll after the elastic member is deformed by a predetermined amount. During normal gas compression, the radial gap between both scrolls is reduced to zero in order to effect the compressive action without leakage, whereas during liquid compression, such a radial gap is generated so that the pressure may be relieved.

8 Claims, 10 Drawing Sheets

FIG. 2B
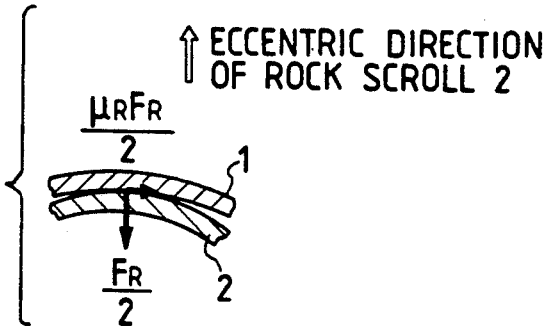
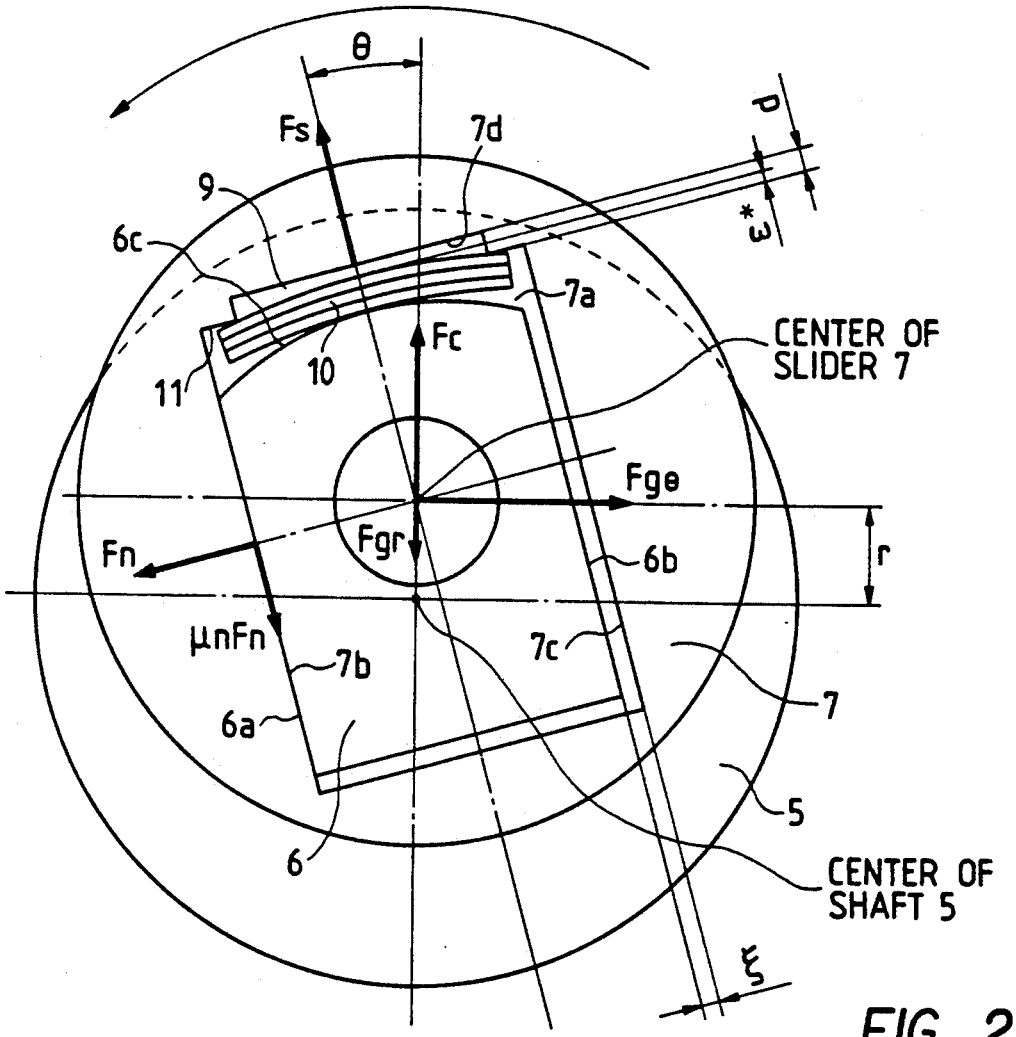
FIG. 2A
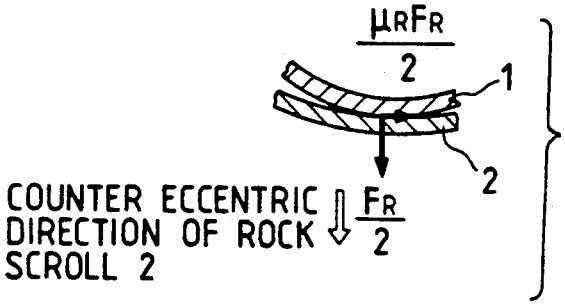
FIG. 2C

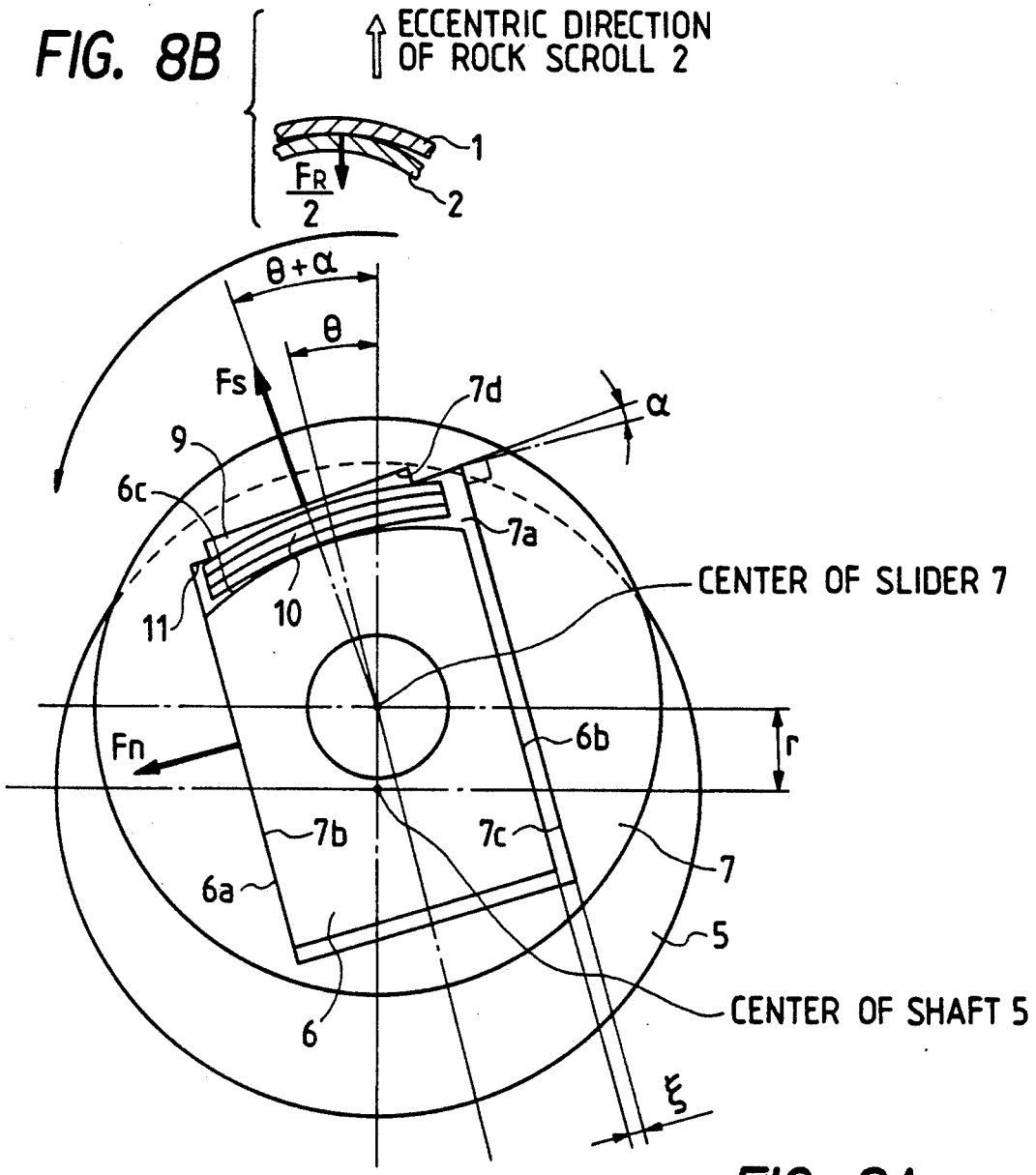
FIG. 8B
ECCENTRIC DIRECTION OF ROCK SCROLL 2
1
2
FR/2
θ+α
θ
Fs
7d
α
9
6c
7a
CENTER OF SLIDER 7
11
10
Fn
6b
r
7b
7c
7
6a
5
CENTER OF SHAFT 5
6
ξ
FIG. 8A
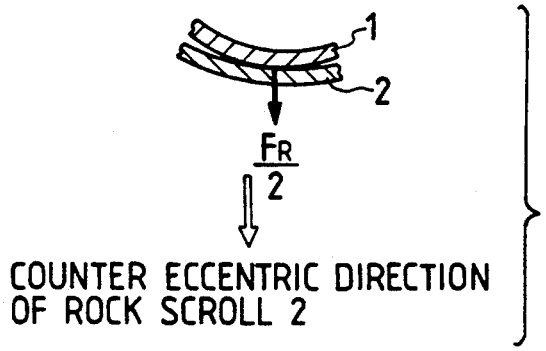
1
2
FR/2
COUNTER ECCENTRIC DIRECTION OF ROCK SCROLL 2
FIG. 8C

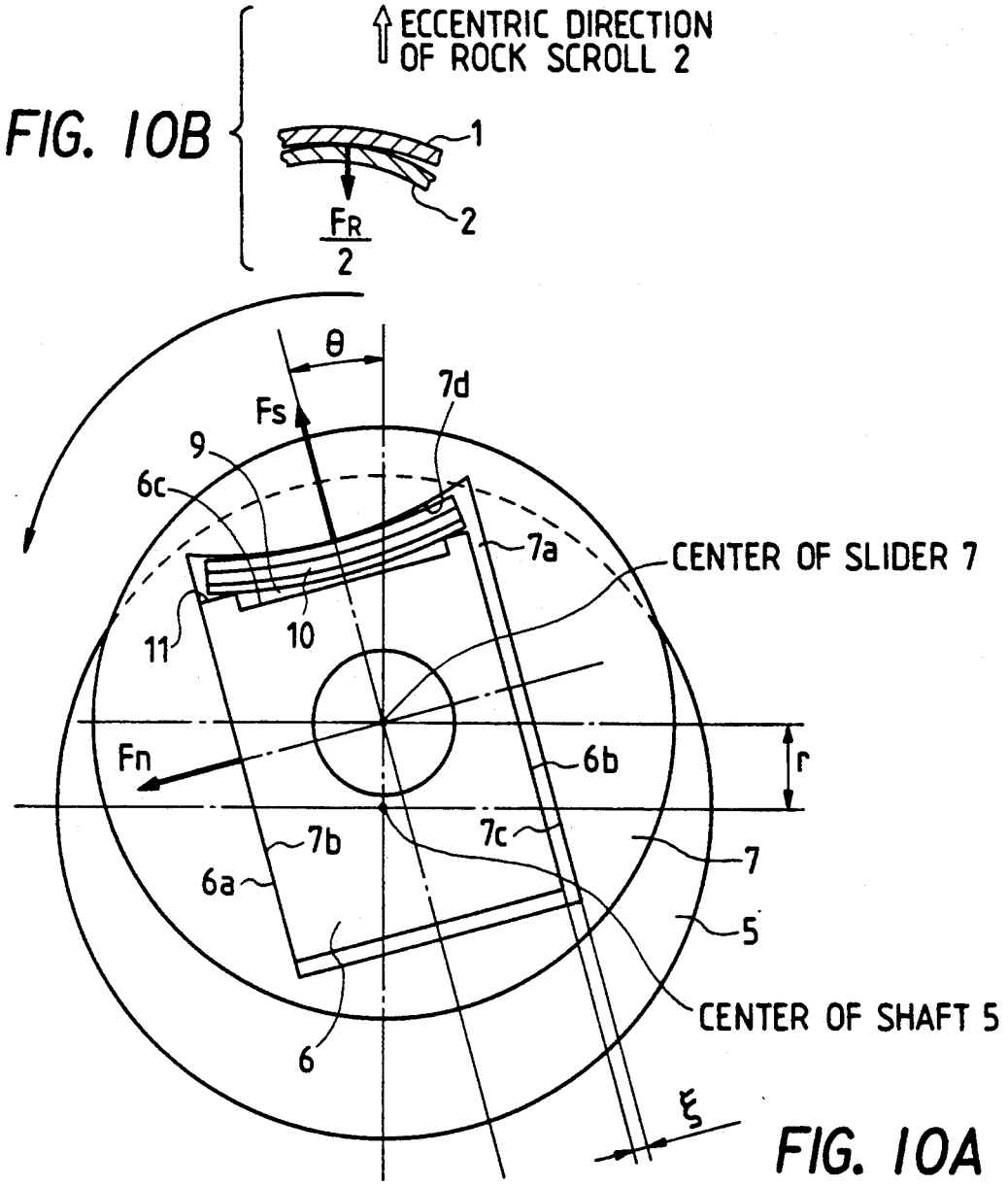
ECCENTRIC DIRECTION OF ROCK SCROLL 2
FIG. 10B
1
2
FR/2
θ
7d
Fs
9
6c
7a
CENTER OF SLIDER 7
11
10
Fn
6b
r
7b
7c
7
6a
5
CENTER OF SHAFT 5
6
ξ
FIG. 10A
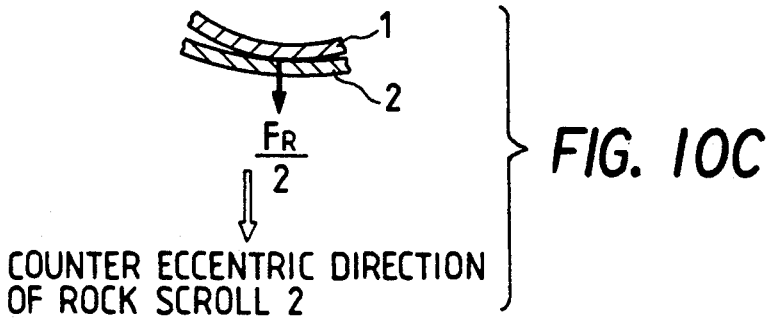
1
2
FR/2
COUNTER ECCENTRIC DIRECTION OF ROCK SCROLL 2
FIG. 10C

SCROLL COMPRESSOR WITH SLIDER CONTACTING AN ELASTIC MEMBER

BACKGROUND OF THE INVENTION

The present invention relates to a scroll compressor having a slider mechanism in the diametrical direction of an orbiting scroll.

FIG. 11 is a longitudinal sectional view of a conventional scroll compressor referred to in Japanese Patent Application No. 29127/1990 of the present inventors and FIG. 12 is a sectional view of the principal part thereof, illustrating the involvement of force acting on that part in operation. In FIG. 11, numeral 1 denotes a fixed scroll; 2, an orbiting scroll; 2a, a base plate; 2b, an orbiting bearing provided in the center of the counter-compression chamber side of the base plate 2a; 3, a frame secured by the fixed scroll 1 with bolts and the like; 4, an Oldham's ring for coupling the orbiting scroll 2 to the frame 3 in such a way as to make it revolve radially while preventing its rotation; and 5, a main shaft with an eccentric slider fitting shaft 6 formed in its upper end portion, the slider fitting shaft 6 having a flat surface 6a and a flat surface 6b in parallel to the axis of the main shaft 5. A slider 7 is fitted to the slider fitting shaft 6 so that it is slidable on the surface perpendicular to the axis of the main shaft 5 but prevented from rotating and that it is fitted in the orbiting bearing 2b in an eccentric state with respect to the axis of the main shaft 5. Numeral 8 denotes a hermetic container.

In FIG. 12, moreover, r represents the distance between the axis of the main shaft 5 (the center of the fixed scroll 1) and that of orbiting bearing 2b (the center of the orbiting scroll 2), that is, an amount of eccentricity; $F_C$, the centrifugal force generated between the orbiting scroll 2 and the slider 7 while the orbiting scroll 2 is revolving; $F_{g\theta}$, a compression load acting on the orbiting scroll 2 in the direction perpendicular to the centrifugal force $F_C$; $F_{gr}$, a compression load acting on the orbiting scroll 2 in the direction opposite to the centrifugal force $F_C$; $F_n$ and $\mu_n$ respectively the contact force between the slider 7 and the flat surface 6a of the slider fitting shaft 6 and a friction coefficient therebetween, and $F_R$, $\mu_R$ the contact force (pressing force) between the fixed scroll 1 and the orbiting scroll 2 in the eccentric and the counter-eccentric directions and a friction coefficient therebetween. Further, C represents the radial gap between the fixed scroll 1 and the orbiting scroll 2, and $\theta$ an angle in the slide direction of the slider 7 with the eccentric direction thereof, the slider 7 being inclined in the counter-rotational direction of the main shaft 5 with respect to the eccentric direction. Although the centrifugal force $F_C$ acts by nature on the center of gravity, and $F_{g\theta}$ and $F_{gr}$ on the middle point between the axes of the main shaft 5 and orbiting bearing 2b, the moment resulting from the positional shifting of these forces is restrained by the Oldham's ring 4 and by preventing the repulsive force from being introduced from the Oldham's ring 4 into the system, it is assumed that these forces are totally acting on the axis of the orbiting bearing 2b, that is, the center of the slider 7. In FIG. 12, moreover, numeral 7a denotes a groove of the slider 7, 7b a contact flat surface of the slider 7, 7c a noncontact flat surface thereof, and 7d one end of the groove in the eccentric direction of the slider.

The operation will subsequently be described. When the main shaft 5 rotates, the orbiting scroll 2 revolves around the axis of the main shaft 5 while being guided by the Oldham's ring 4, whereby the compressive action is performed on the well known compression principle. During the steady operation, the slider 7 varies by the eccentric amount r determined by both scrolls in its slide direction, that is, up to the position where the orbiting scroll 2 contacts the fixed scroll 1 due to a component of the force in the slide direction of the resultant force of the centrifugal force $F_C$ and the compression loads $F_{g\theta}$, $F_{gr}$. Then the slider 7 presses the orbiting scroll 2 against the fixed scroll 1 and sets a radial gap C to 0 so that the compression action is initiated, the radial gap being provided between the eccentric and counter-eccentric directions of both scrolls. Moreover, the slider 7 is capable of sliding fore and back in the slide direction after it has slid by the eccentric amount r. Since both scrolls slide until they contact each other even when the shape of the spiral body between the fixed scroll 1 and the orbiting scroll 2 has shifted in a dimension, the radial gap C can always be set to zero during one revolution.

The force acting on the slider 7 and the orbiting scroll 2 includes, as shown in FIG. 12, the centrifugal force $F_C$, the gas loads $F_{g\theta}$, $F_{gr}$, the contact force $F_R$ between the fixed scroll 1 and the orbiting scroll 2, and the frictional force $\mu_R F_R$ resulting from the contact force $F_R$, and the frictional force $\mu_n F_n$ resulting from (the repulsive force of) the contact force $F_n$ between the slider 7 and the flat surface 6a. In FIG. 12, $\mu_n F_n$ indicates the slide direction of the slider 7 in which the eccentric amount r increases because of the shifting (unevenness) of the shape of the spiral body. When the balance between the sliding direction of the slider 7 and the force perpendicular thereto is taken into consideration, the following expression may be introduced:

$$(F_C - F_{gr} - F_R)\cos\theta + (F_{g\theta} + \mu_R F_R)\sin\theta = \mu_R \mu_n \quad (1)$$

$$(F_C - F_{gr} - F_R)\sin\theta - (F_{g\theta} + \mu_R F_R)\cos\theta = -F_n \quad (2)$$

When $F_n$ is eliminated from Eqs. (1) (2) and when the rest is subsequently solved for $F_R$, the contact force $F_R$ between the fixed scroll 1 and the orbiting scroll 2 is expressed by $$F_R = \{(F_C - F_{gr})(\cos\theta + \mu_n \sin\theta) + F_{g\theta}(\sin\theta - \mu_n \cos\theta)\}/\{(\mu_R\mu_n + 1)\cos\theta + (\mu_n - \mu_R)\sin\theta\} \quad (3)$$

With respect to Eq. (3), if the force acting on the slider 7 and the orbiting scroll 2 is simplified with $\mu_R = \mu_n = 0$, the following model is assumed:

$$F_R = (F_C - F_{gr}) + F_{g\theta}\tan\theta \quad (4)$$

Since the mechanical properties of the scroll compressor are represented by $F_{g\theta} >> F_{gr}$, the greater $F_{g\theta}$, the greater $F_R$ becomes in the case of the slider mechanism as shown in Eq. (3) or (4).

Refrigeration or air-conditioning compressors often cause liquid compression in which a liquid refrigeration medium is directly compressed while the liquid refrigeration medium is still asleep in the compression chamber, that is, during so-called still-sleep starting, or while a large amount of liquid refrigeration medium is flowing into the suction pipe, that is, during liquid back operation. In this case, the pressure tends to leak from an outlet in the innermost compression chamber among a plurality of compression chambers constituting the scroll compressor and therefore the pressure is not increased conspicuously. However, the pressure is caused to increase noticeably in an intermediate or the outermost compression chamber unless there is provided a pressure escape therein. $F_{g\theta}$ greatly increases in this state. Notwithstanding, $F_{gr}$ will not increase since it is the load determined by the difference between the exhaust and suction pressures and since the exhaust pressure is determined by the condensation temperature in view of the construction of such a scroll compressor. In the aforementioned conventional slider mechanism, while $F_R$ is growing at the time of liquid compression as shown by Eqs. (3), (4), that is, while the radial gap between both scrolls remains at zero at that time, the pressure in the intermediate or the outermost compression chamber (particularly in the intermediate pressure chamber) sharply increases because there is no escape therein. As a result, the increased pressure or $F_R$ that has sharply grown at the contact point between both scrolls may cause the spiral bodies of both scrolls to snap and break.

In another slider mechanism, it may be contrived to make the slide direction of the slider 7 conform to its eccentric direction. However, the contact force $F_R$ between the fixed scroll 1 and the rock scroll 2 is given by $$F_R = F_C - F_{gr} \pm \mu_n F_{g\theta} \quad (5)$$

since $F_n = F_{g\theta}$. In this case, the sign denotes the occasion where the slider 7 slides in the direction in which the eccentric mount r increases because of the unevenness of the spiral sides of both scrolls in the lower case and conversely it slides in the direction in which the eccentric amount r decreases in the upper case. From Eq. (5), $F_R < 0$ while the slider 7 is sliding in the direction in which the eccentric amount increases when $F_{g\theta}$ sharply increases because of the liquid compression. Although the slider 7 tries moving back then, this means the slider 7 is to slide in the direction in which the eccentric amount decreases and therefore $F_R > 0$ from Eq. (5). Ultimately, the slider 7 becomes stabilized in that state in view of the frictional force $\mu_n F_{g\theta}$ and there develops only an extremely small radial gap equivalent to the difference in the unevenness of the order of microns between the spiral body sides of both scrolls. The pressures in the intermediate and outermost compression chambers markedly increase because of the liquid compression and the gap of the order of microns is incapable of relieving the pressure. As a result, the pressure may cause the spiral bodies of both scrolls to snap and break.

In still another slider mechanism, unlike the aforementioned conventional one, it may be contrived to incline the slide direction of the slider 7 by $\theta$ toward its eccentric direction in the rotational direction of the main shaft 5. In this case, the contact force $F_R$ between the fixed scroll 1 and the orbiting scroll 2 is simplified by making reference to Eq. (4) and the following model is assumed:

$$F_R = (F_C - F_{gr}) + F_{g\theta} \tan\theta \quad (6)$$

In this method, however, $F_R < 0$ as $F_{g\theta}$ increases at the time of liquid compression, that is, the slider 7 moves back and produces a radial gap between both scrolls, thus allowing the pressures in the intermediate and outermost compression chambers to be relieved as pressure escapes are provided therein. During normal gas compression, however, the following condition must be met from Eq. (6):

$$F_C > F_{gr} + F_{g\theta} \tan\theta \quad (7)$$

to effect compression with the radial gap as zero, that is, to establish $F_R > 0$. Notwithstanding, it is difficult to satisfy the condition of Eq. (7) with reference to every operating condition on the unit. There exists the operating condition under which the radial gap is produced between both scrolls as the slider 7 moves back when $F_R < 0$ is established even at the time of gas compression.

When the slide direction of the slider is inclined toward its eccentric direction or toward the eccentric direction by $\theta$ in the counter-rotational direction of the main shaft in the slider mechanism of the conventional scroll compressor, the radial gap between both scrolls becomes as extremely small as what is in the order of microns or almost nearly zero at the time of liquid compression. As the pressure is not allowed to be relieved, the spiral bodies may be caused to snap because of the high pressure produced by the liquid compression. When the slide direction of the slider is inclined toward its eccentric direction by $\theta$ in the rotational direction of the main shaft, moreover, the radial gap is produced between both scrolls under such an operating condition that the condition of $F_C > F_{gr} + F_{g\theta} \tan\theta$ cannot be met during the normal gas compression and this poses a problem in that no compressive action is performed.

SUMMARY OF THE INVENTION

An object of the present invention is to obviate the foregoing problems by providing a scroll compressor having a slider mechanism for performing a compressive action while reducing to zero the radial gap between both scrolls in the eccentric and counter-eccentric directions by pressing an orbiting scroll against a fixed scroll during the normal gas compression and for relieving the pressure by sliding a slider in a direction in which the eccentric amount decreases when the pressure in a compression chamber increases as in the case of liquid compression so as to cause the radial gap between both strolls to be produced.

A scroll compressor according to the present invention is constructed through the steps of inclining the slide direction of a slider toward the eccentric direction of an orbiting scroll by a predetermined amount in the rotational direction of a main shaft, providing a stage on the groove end side in the eccentric direction of the slider, inserting an elastic flat plate in the stage between the groove end side in the eccentric direction and a slider fitting shaft while both ends of the plate are supported, forming the slider fitting shaft in an arcuate configuration as long as the contact surface between the slider fitting shaft and the flat plate is concerned, and setting the distance between the center of the main shaft inserted in such a state that the flat plate stays notdeformed and that of the slider greater than the eccentric amount r determined by the fixed and orbiting scrolls and when the flat plate is deformed by a predetermined dimension, making the spiral bodies of both scrolls radially contact each other in the eccentric and counter-eccentric directions of the orbiting scroll, that is, making the distance therebetween equal to the predetermined eccentric amount r.

Another scroll compressor according to the present invention is such that, unlike the scroll compressor as above-mentioned the groove end side in the eccentric direction of the slider is not made to orthogonally intersect the flat contact surface and the noncontact flat surface of the slider but inclined by a predetermined amount toward the noncontact surface side.

In the scroll compressor according to the present invention, the spiral bodies of both the orbiting and fixed scrolls radially contact in the eccentric and counter-eccentric directions in such a state that both scrolls have properly been combined, thus causing the slider to slide until the flat plate is deformed by the predetermined dimension. In the state where the predetermined eccentric amount r has been attained, the deformed flat plate produces a spring force for pressing the orbiting scroll against the fixed scroll, whereby while the spiral bodies of both scrolls contact each other (the contact force $F_R>0$) in the eccentric and counter-eccentric directions during the normal gas compression, that is, while the radial gap remains at zero at all times, the compressive action is performed. When the compression load $F_{g\theta}$ increases in the direction perpendicular to the eccentric direction as the pressure in the compression chamber increases at the time of liquid compression, the force causing the slider to slide in the direction in which the eccentric amount decreases tends to grow, so that the slider is slid in the direction in which the eccentric amount decreases. As a result, the radial gap is produced between both scrolls, so that the pressure can be relieved.

Furthermore, in the scroll compressor according to the present invention, the slider is allowed to move in parallel to the direction perpendicular to the slide direction, and the noncontact flat surface contacts the slider fitting shaft to ensure that the deformation of the flat plate is reduced to zero, that is, the spring force is reduced to zero. Therefore, the fitting of the fixed scroll can be accomplished in the state where the spring force has been reduced to zero.

BRIEF DESCRIPTION OF THE DRAWINGS

FIGS. 2A–2C are sectional views of the principal part of FIG. 1, illustrating the involvement of force acting on that part in operation.

FIGS. 5A–5C are diagrams illustrating the involvement of force acting on the principal part of the scroll compressor in its static state in the first embodiment of the present invention.

FIGS. 8A–8C are sectional views of the principal part of another scroll compressor, illustrating the involvement of force in its static state, in a second embodiment of the present invention.

FIGS. 10A–10C are sectional views of the principal part of still another scroll compressor in a third embodiment of the present invention.

DETAILED DESCRIPTION OF THE PREFERRED EMBODIMENTS

Embodiment 1

Figure 1:
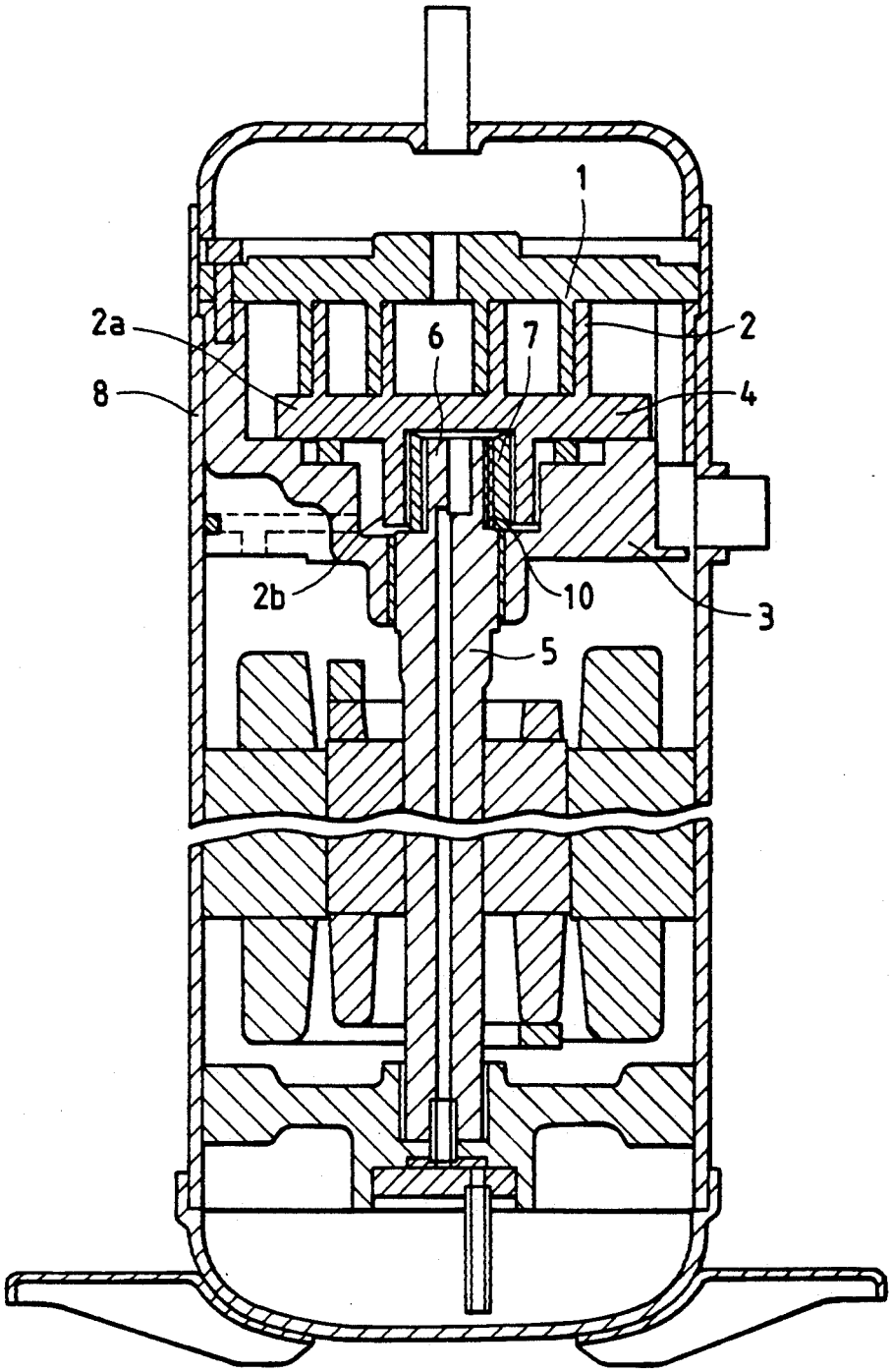
FIG. 1 is a longitudinal sectional view of a scroll compressor embodying the present invention.

Referring to FIG. 1, an embodiment of the present invention will subsequently be described. FIG. 1 is a longitudinal sectional view of a scroll compressor having a slider mechanism in a first embodiment of the present invention and FIG. 2 is the principal part of FIG. 1, illustrating the involvement of force acting on a slider 7 and an orbiting scroll 2, wherein like reference characters designate like or corresponding parts of the conventional scroll compressor. In FIG. 2, numeral 7 denotes a slider 7 whose slide direction is inclined toward its eccentric direction by $\theta$ in the rotational direction of a main shaft 5; 9, a recess provided on the groove end side **7*d* in eccentric direction of the slider 7; and 10 an elastic flat plate inserted in the stage while both ends of the plate are supported. The distance between the center of the main shaft 5 inserted in such a state that the flat plate stays not-deformed and that of the slider 7 is set greater than the eccentric amount r determined by both scrolls. However, the flat plate 10** is deformed by a predetermined amount $\epsilon^*$ when both scrolls are combined, so that both scrolls may radially contact each other. Further, numeral 11 denotes a pedestal in contact with the flat plate 10, and the groove end side **7*d* in the eccentric direction of the slider 7 comprises the recess 9 and the pedestal 11, thus orthogonally intersecting a contact flat surface 7*b* and a noncontact flat surface 7*c*. Further, numeral 6 denotes a slider fitting shaft; 6*c*, an arcuate contact surface with the flat plate 10, this surface being simultaneously in a linear contact state with the flat plate 10 in the center of the recess 9. In this case, a plurality of flat plates 10 may be employed. A gap $\xi$ is provided between the flat surface 6*b* of the slider fitting shaft 6 and the noncontact flat surface 7*c* of the slider 7 during the operation. In FIG. 1, a frame is fixedly fitted by shrinkage fit manner in a hermetic container 8 and a fixed scroll 1 is fixed to the frame 3 with bolts. Moreover, an orbiting bearing 2*b* is projected in the center of the counter-compression side of the base 2*a* of the orbiting scroll 2**.

The operation during the movement will subsequently be described. When the fixed scroll 1 and the orbiting scroll 2 are combined, the flat plate 10 is deformed by the predetermined amount $\epsilon^*$ and the spiral bodies of both scrolls radially contact each other, that is, the distance between the center of the main shaft 5 and that of the slider 7 accords with the eccentric amount r determined by both scrolls. The flat plate 10 acts on a plate spring, thus generating a spring force $F_S$. The following expression is obtainable from the balance between forces acting on the slider 7 and orbiting scroll 2 during the operation:

$$(F_C-F_{gr}-F_R)+F_s\cos\theta-F_n\sin\theta-(\pm\mu_nF_n\cos\theta)=0 \quad (8)$$

$$(F_{g\theta}=\mu_RF_R)-F_S\sin\theta-F_n\cos\theta\pm\mu_nF_n\sin\theta=0 \quad (9)$$

In this case, the sign denotes the occasion where the slider 7 slides in the direction in which the eccentric amount r increases because of the unevenness of the spiral sides of both scrolls in the upper case and conversely it slides in the direction in which the eccentric amount r decreases in the lower case. In FIG. 2, $\mu_nF_n$ is represented by the direction generated when the slider 7 slides in the direction in which the eccentric amount increases.

From Eqs. (8), (9), the following two expressions are derived.

$$F_S=-(F_C-F_{gr}-F_R)\cos\theta+(F_{g\theta}+\mu_RR_R.)\sin\theta\pm\mu_nF_n \quad (10)$$

$$F_n=(F_C-F_{gr})\sin\theta+F_{g\theta}\cos\theta-F_R(\sin\theta-\mu_R\cos\theta) \quad (11)$$

When Eq. (11) is substituted for Eq. (10), $$F_R=[F_S+(F_C-F_{gr})\{\cos\theta-(\pm\mu_R\sin\theta)\}-F_{g\theta}(\sin\theta\pm\mu_n\cos\theta)\}[\cos\theta+\mu_R\sin\theta-\{\pm\mu n(\sin\theta-\mu_R\cos\theta)\}] \quad (12)$$

However, Eq. (12) is established at only $F_R>0$ and an area of $F_R<0$ is $F_R=0$, which means the slider 7 moves back in the direction in which the eccentric amount r decreases, thus providing the radial gap for both scrolls.

Figure 3:
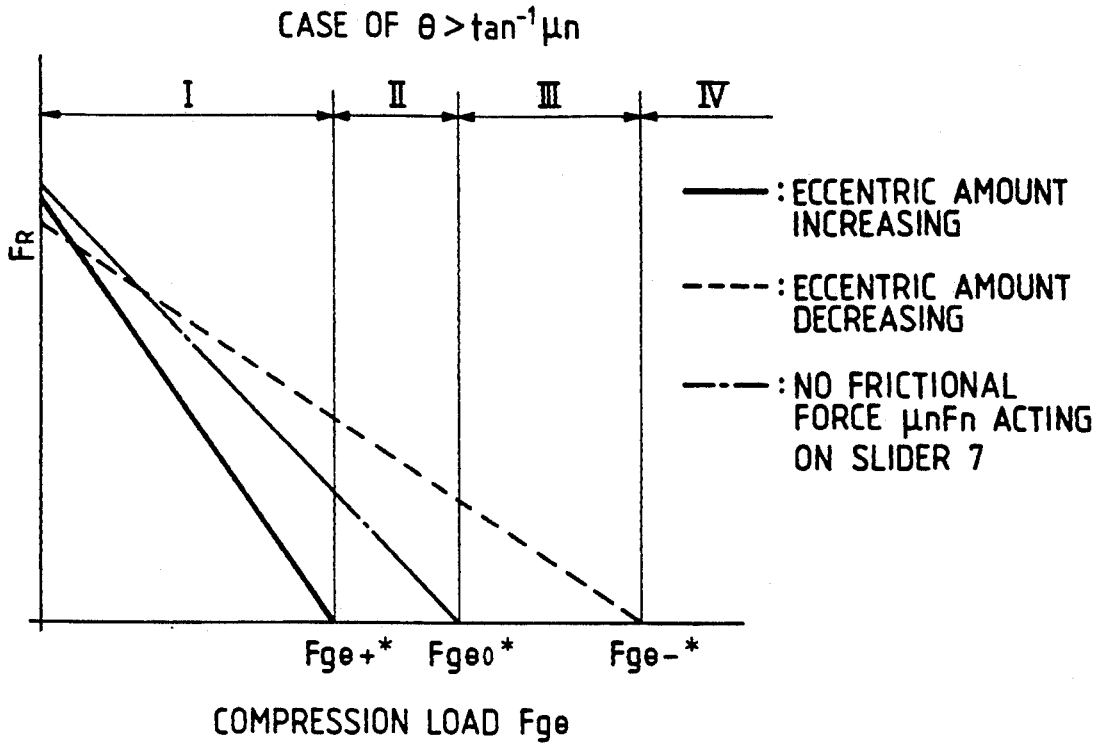
FIG. 3 is a graph illustrating the relation between $F_R$ and $F_{g\theta}$ of the scroll compressor in the first embodiment of the present invention.

From Eq. (12), the relation between $F_R$ and $F_{g\theta}$ is established as shown in FIG. 3 when $\theta>\tan^{-1}\mu_n$. In FIG. 3, $F_{g\theta+}*$ represents $F_{g\theta}$ conforming to $F_R=0$ while the eccentric amount is increasing, $F_{g\theta-}*$ represents $F_{g\theta}$ conforming to $F_R=0$ while it is decreasing, and $F_{g\theta0}*$ represents $F_{g\theta}$ conforming to $F_R=0$ when the frictional force $\mu_nF_n$ acting on the slider 7 is nonexistent, that is, when no unevenness exists on the spiral side surface in such a state that the slider 7 remains stable in the slide direction. With $F_R=0$ in Eq. (12), these can be obtained as follows:

$$F_{g\theta+}*=\{F_S+(F_C-F_{gr})(\cos\theta-\mu_n\sin\theta)\}/(\sin\theta+\mu_n\cos\theta) \quad (13)$$

$$F_{g\theta-}*=\{F_S+(F_C-F_{gr})(\cos\theta-\mu_n\sin\theta)\}/(\sin\theta+\mu_n\cos\theta) \quad (14)$$

$$F_{g\theta0}=\{F_S+(F_C-F_{gr})(\cos\theta)\}/\sin\theta \quad (15)$$

If the area is divided into four as shown in FIG. 3, a. $F_{g\theta}\leqq F_{g\theta+}*$ b. $F_{g\theta+}*<F_{g\theta}\leqq F_{g\theta0}*$ c. $F_{g\theta0}*<F_{g\theta}<F_{g\theta-}*$ d. $F_{g\theta-}*\leqq F_{g\theta}$ the slider 7 is to operate as follows depending on the value of $F_{g\theta}$.

a: Since the force $F_R$ with which the orbiting scroll 2 presses the fixed scroll 1 is $F_R>0$, irrespective of the fact that the eccentric amount r increases or decreases, both scrolls are allowed to contact each other in both eccentric and counter-eccentric directions and the radial gap remains at zero. In other words, the slider 7 keeps following the spiral bodies of both scrolls.

b and c: Of the position where the spiral bodies of both scrolls contact, the slider 7 slides up to a position where the spiral side face is uneven and where the eccentric amount is smallest, and at that position, the force with which it is caused to return to the original position, that is, it is caused to slide in the direction in which the eccentric amount increases in the case of b, or the force with which it is caused to slide in the direction in which the eccentric amount decreases further in the case of c, and the frictional force $\mu_nF_n$ are balanced so that the slider 7 is stabilized. In other words, there develops a gap equivalent to the difference resulting from subtracting the unevenness of the spiral bodies of both scrolls from their machining accuracy.

d: With $F_R<0$ at all times, the slider 7 moves back. In other words, the radial gap occurs between both scrolls and this makes it possible to relieve the pressure therein. When the slider 7 moves back in the direction in which the eccentric amount decreases, the deformation of the flat plate 10 becomes greater than $\epsilon*$ and consequently the spring force $F_S$ increases, thus causing the slider 7 to move back up to the place where it harmonizes well with the spring force.

As set for the above, given $F_{g\theta max}$ as extremely great $F_{g\theta}$ at the time of liquid compression at which both scrolls snaps and break, that is, $F_{g\theta}$ in such a state that both scrolls may be injured from the standpoint of their strength, $$F_{g\theta-}*\leqq F_{g\theta max} \quad (16)$$

Given maximum $F_{g\theta}$ during the operation of the unit at the time of normal gas compression as $F_{g\theta n}$, moreover, $$F_{g\theta+}*\geqq F_{g\theta n} \quad (17)$$

If $\theta$ and $F_S$ are given in such a way as to satisfy the relation between both equations, it would be possible to effect the compressive action with the radial gap always set at zero at the time of normal gas compression, or to move back the slider 7 in the direction in which the eccentric amount decreases to provide the radial gap so as to relieve the pressure when the pressure in the compression chamber increases at the time of liquid compression, that is, when $F_{g\theta}$ tends to increase up to the state where both scrolls may be injured from the standpoint of their strength.

Although there exists $F_{g\theta}$ to the extent that both scrolls pose no problem from the standpoint of their strength between $F_{g\theta n}$ and $F_{g\theta max}$ during the operation of packing a small amount of liquid, a great $F_{g\theta}$ exists during gas compression. If the condition stipulated for in Eq. (16) is substituted for what is in Eq. (17), $$F_S\leqq F_{g\theta max}(\sin\theta-\mu_n\cos\theta)-(F_C-F_{gr})(\cos\theta+\mu_n\sin\theta)\equiv F_{S1} \quad (16)'$$

If the condition stipulated for in Eq. (17) is substituted for those in Eq. (13), $$F_S\geqq F_{g\theta n}(\sin\theta-\mu_n\cos\theta)-(F_C-F_{gr})(\cos\theta+\mu_n\sin\theta)\equiv F_{S2} \quad (17)'$$

As the condition stipulated for in Eqs. (16)', (17)' conforms to $F_{S1}\geqq F_S\geqq F_{S2}$, $F_{S1}\geqq F_{S2}$ has to be established and an inclination $\theta$ toward the eccentric direction in the slide direction of the slider to the satisfaction of the condition is given by $$\theta \geqq \tan^{-1}[\mu_n(F_{g\theta max}+F_{g\theta n})/\{(F_{g\theta max}-F_{g\theta n})-2\mu_n(F_C-F_{gr})\}] \quad (18)$$

In order to satisfy Eqs. (16) and (17), from Eq. (18)

$$\theta=\tan^{-1}[\mu_n(F_{g\theta max}+F_{g\theta n})/\{(F_{g\theta max}-F_{g\theta n})-2\mu_n(F_C-F_{gr})\}] \quad (19)$$

If Eq. (19) is substituted for Eq. (17)', $$F_S=F_{g\theta n}(\sin\theta-\mu_n\cos\theta)-(F_C-F_{gr})(\cos\theta+\mu_n\sin\theta) \quad (20)$$

or if Eq. (19) is substituted for Eq. (16)'

$$F_S=F_{g\theta max}(\sin\theta-\mu_n\cos\theta)-(F_C-F_{gr})(\cos\theta+\mu_n\sin\theta) \quad (21)$$

The values obtained from Eqs. (20), (21) naturally accord with each other. Therefore, the predetermined deformation amount $\epsilon^*$ of the flat plate 10 is determined so that it is harmonized with $F_S$ obtainable from Eq. (20) or (21). However, $\epsilon^*$ cannot always be set optionally in view of the strength and the shape of the flat plate 10.

Figure 4:
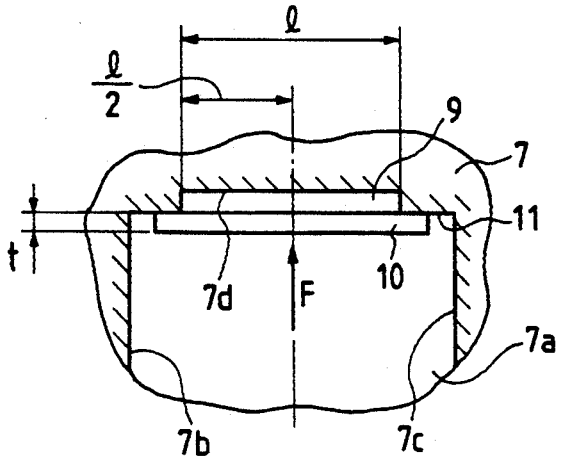
FIG. 4 is a constitutional diagram of a flat plate of the scroll compressor in the first embodiment of the present invention.

A detailed description will subsequently be given of the flat plate 10 made to function as a plate spring. The flat plate 10 is, as shown in FIG. 4, inserted on the groove end side *7d* in the eccentric direction of the slider. Since the flat plate 10 is regarded as a beam freely supported with respect to the corner of the pedestal 11, given l as the width of the recess 9, t the thickness and h the height of the flat plate 10, the displacement $\epsilon$ and stress $\sigma$ is given by $$\epsilon=Fl_3/(4Eht^3) \quad (22)$$

where E is the Young's modulus.

$$\sigma=(3/2)\cdot Fl/(ht^2) \quad (23)$$

Therefore, $$\sigma/\epsilon=6tE/l^2 \quad (24)$$

From Eq. 22, the load F is obtained from $$F=(4Eht^3/l^3)\cdot\epsilon \quad (25)$$

The stress $\sigma$ is restricted in view of the strength of the material of the flat plate 10 and $\epsilon$ may be left in such a situation that it stays not-deformed even though both scrolls are combined unless a certain value of $\epsilon$ is secured when the bearing gap around the main shaft 5 in addition to the dimensional tolerances of the slider 7 and the slider fitting shaft 6 are taken into consideration. Consequently, the common design practice is to give $\sigma/\epsilon$ a set value. Although it is only needed to increase l or decrease t in order to the value $\sigma/\epsilon$ less than the set value, l is limited in configuration and if t is decreased, the load F decreases when the flat plate 10 is deformed by the predetermined amount $\epsilon^*$. For this reason, l is set as large as possible at the time the flat plate 10 is actually designed to seek t and if F thus obtained is smaller than $F_S$, the number of flat plates 10 is increased to make $F_S$=nF. In other words, the thickness t of the flat plate 10 and the number of them n are adjusted to attain $F_S$ obtained from Eqs. (20) or (21). Flat plates 10 having different t are combined to make the total F being $F_S$.

Moreover, provided the maximum tolerance stress is given as $\sigma$a, the depth d of the recess 9 is set to $$d=\sigma al^2/(6tE) \quad (26)$$

from Eq. (26), whereby since the maximum displacement amount of the flat plate 10 is determined to be d, the stress of the flat plate 10 will never exceed the maximum tolerance stress $\sigma$a as the edge face of the recess 9 functions as a stopper to restrict the deformation of the flat plate 10 even though the slider 7 tends to slide further owing to the fact that the force causing the slider 7 to slide in the direction in which the eccentric amount decreases and the spring force $F_{SMAX}$ are unbalanced when the flat plate 10 is deformed by d. In this way, the maximum radial gap between both scrolls is also determined when the pressure is relieved, that is, the maximum relief amount $\delta_{max}$ is given by $$\delta_{max}=r-\{r^2-2r(d-\epsilon^*)\cos\theta+(d-\epsilon^*)^2\}^{\frac{1}{2}} \quad (27)$$

Figure 5A:
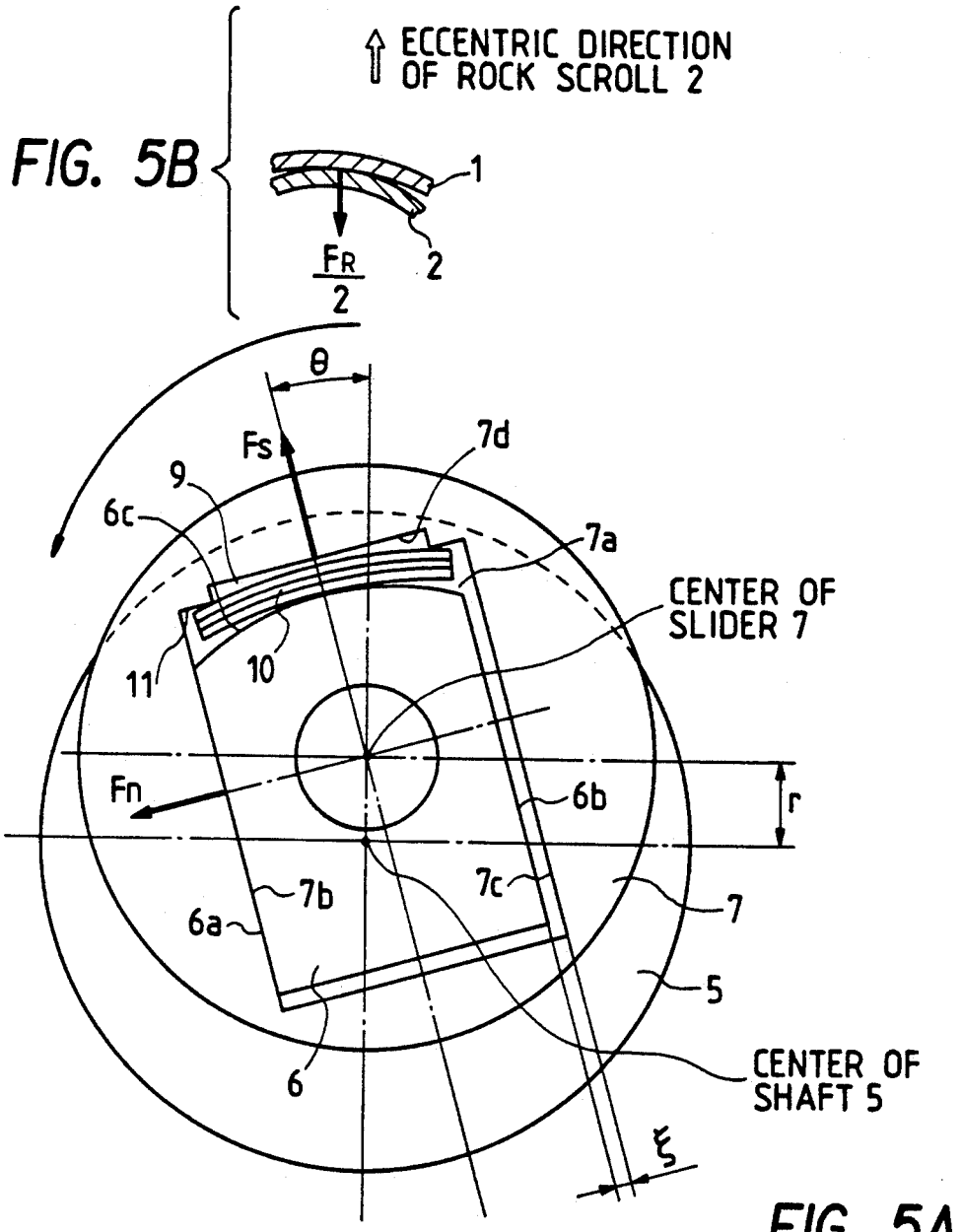
Figure 5C:
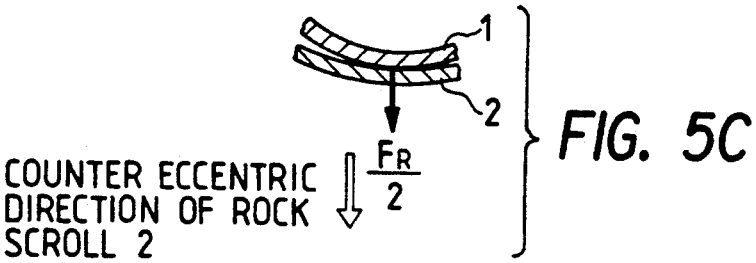

A description will subsequently be given of a method of combining both scrolls in the scroll compressor having the slider mechanism. The scroll compressor in this embodiment is constructed through the steps of fitting the slider 7 and the flat plate 10 to the projected slider fitting shaft 6 on the upper side of the frame 3 fixedly fitted to the hermetic container 8 by baking, fitting the slider 7 in the orbiting bearing *2b*, fitting the Oldham's ring 4 in the Oldham's groove provided in the base *2a* of the orbiting scroll 2 after the frame 3 is fitted to the Oldham's ring 4 so as to fit the orbiting scroll 2, and lastly fitting the fixed scroll 1 to the frame 3 with bolts by combining the orbiting scroll 2 with the spiral bodies. However, the fixed scroll 1 has to be fitted by overcoming the spring force $F_S$ to combine the spiral bodies of both scrolls directly as in the case of the normal operation because the spring force $F_S$ is generated by deforming the flat plate 10 by the predetermined amount $\epsilon^*$. In other words, the fixed scroll 1 has to be shifted by $\epsilon^*$ with the force $F_S$ (whereby the flat plate 10 is deformed by $\epsilon^*$) to tighten the fixed scroll 1 against the frame 3 with bolts. However, $F_S$ amounts to several hundreds of kgf in a large-sized compressor and it is impossible to mount the fixed scroll 1 unless a specific jig is employed. The relation between the forces respectively acting on the slider 7 and the orbiting scroll 2 when both scrolls are combined is considered. FIG. 5 illustrates the involvement of forces acting on the slider 7 and the orbiting scroll 2 in their static state. As FIG. 5 refers to the static state, these forces, unlike the case of FIG. 2, are exerted only during the operation. $F_{g\theta}$, $F_C$, $F_{gr}$ and the frictional force $\mu_nF_n$, $\mu_RF_R$ are inactive. In FIG. 5, the following two expressions are obtainable when the forces are weighed in the balance.

$$F_S\cos\theta-F_R-F_n\sin\theta=0 \quad (28)$$

$$-F_S\sin\theta-F_n\cos\theta=0 \quad (29)$$

The following expression is introduced from Eqs. (28), (29):

$$F_R=F_S/\cos\theta \quad (30)$$

$$F_n=-F_R\sin\theta=-F_S\tan\theta \quad (31)$$

Figure 6:
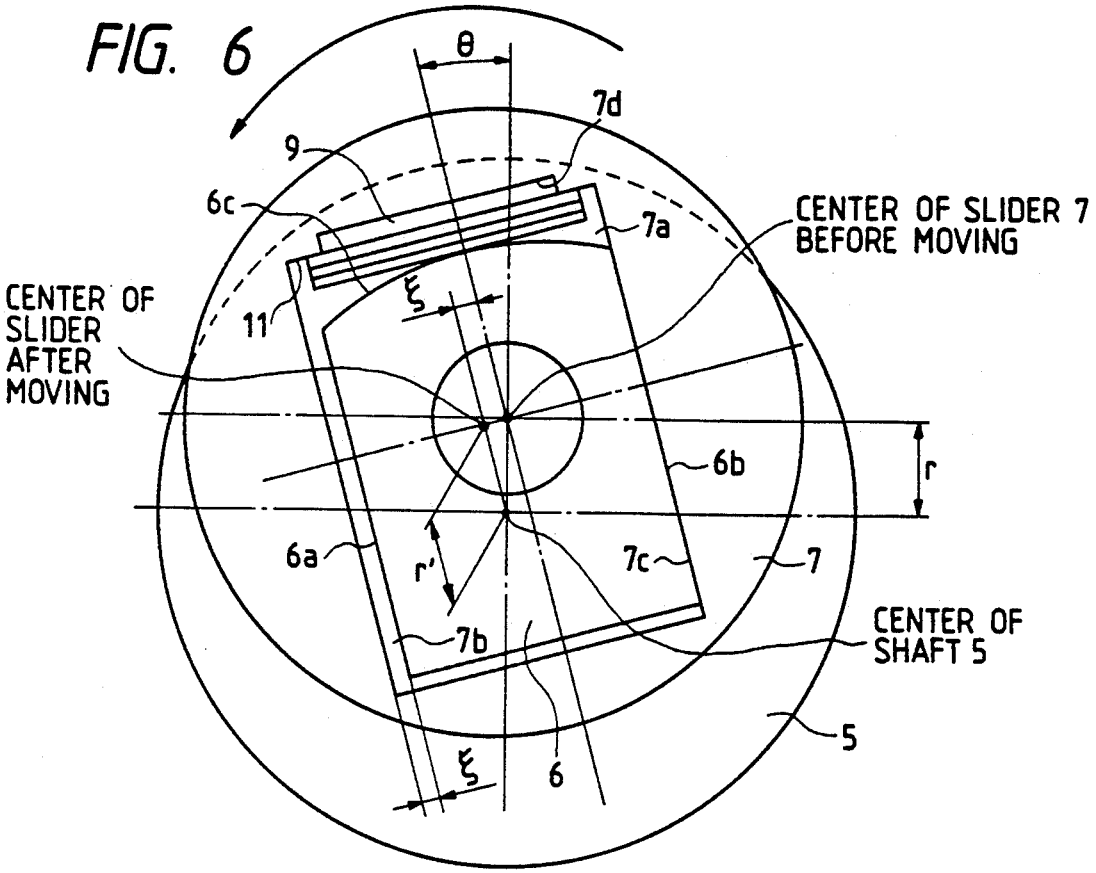
FIG. 6 is a sectional view of the principal part of the scroll compressor in the static state after its slider has made a parallel movement in the first embodiment of the present invention.
Figure 7:
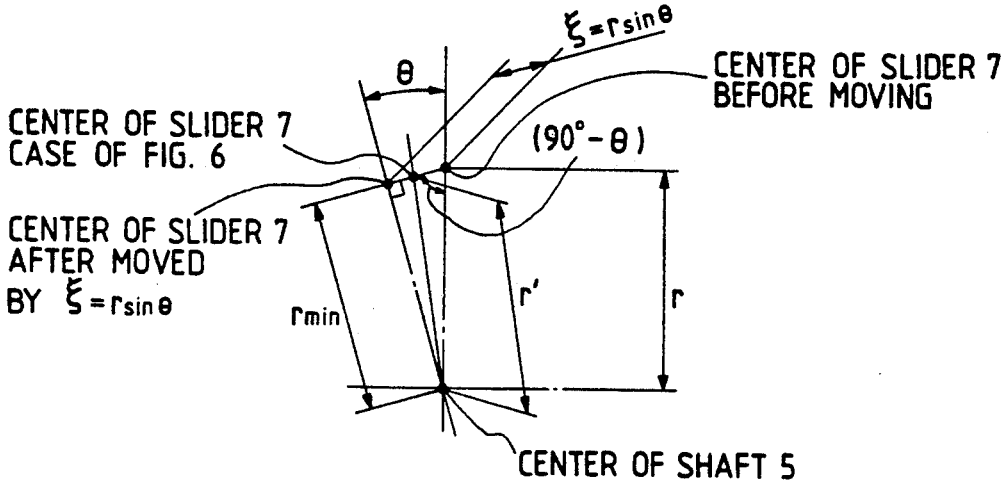
FIG. 7 is a diagram illustrating the variation of the eccentric amount of the slide which has made the parallel movement in the static state of the scroll compressor in the first embodiment of the present invention.

Therefore, $F_n<0$ is established from Eq. (31) in the static state and the contact surface between the slider 7 and the slider fitting shaft 6 during the operation is reversed. In other words, the contact flat surface 7b of the slider comes in contact with the flat surface 6a of the slider fitting shaft during the operation. The gap $\xi$ that has existed between the noncontact flat surface 7c of the slider and the flat surface 6b of the slider fitting shaft is replaced with the gap $\xi$ between the contact flat surface 7b and the flat surface 6a as the slider 7 moves in parallel to the direction perpendicular to the slide direction, thus conversely causing the noncontact flat surface 7c to contact the flat surface 6b in the static state. FIG. 6 is a sectional view of the principal part in the static state after the slider 7 has moved. As shown in FIG. 7, the distance between the center of the main shaft 5 and that of the slider 7 after the slider 7 has moved, that is, the eccentric amount r' becomes smaller than the eccentric amount r during the operation. When the slider 7 slides in parallel to the slide direction, that is, in the direction in which the eccentric amount decreases, that is, when the pressure is relieved, the flat plate 10 is deformed by $\epsilon^*$ or greater. However, the slider 7 slides in parallel to the direction perpendicular to the slide direction in the static state and the eccentric amount becomes smaller than the eccentric amount during the operation, whereby the deformation of the flat plate 10 becomes smaller than $\epsilon^*$. In order to make the slider 7 slide in parallel to the direction perpendicular to the slide direction, the absolute value of $F_n$ obtainable from Eq. (31) has to be greater than frictional force $\mu_S F_S$, given the frictional coefficient $\mu_S$ between the arcuate contact surface 6b of the slider fitting shaft and the flat plate 10, and this condition is given by the following expression:

$$|Fn| > \mu_S F_S$$

From Eq. (31), $$F_S \tan\theta > \mu_S F_S$$

Therefore, $$\theta > \tan^{-1}\mu_S \tag{32}$$

Provided this value conforms to the value of $\theta$ obtained from Eq. (9) the normal value of the frictional coefficient $\mu_S$ is always satisfied.

The eccentric amount r' after the movement is given by $$r' = \{(r-\xi)^2 + 2r\xi(1-\sin\theta)\}^{\frac{1}{2}} \tag{33}$$

and a decrease in the eccentric amount $\Delta r = r - r'$. If therefore $\xi$ satisfying $\Delta r \geqq \epsilon^*$ is given, the flat plate 10 remains entirely not-deformed. In other words, the spring force is reduced to zero in the static state. If the orbiting scroll 2 together with the slider 7 is moved in parallel in such a way as to make the noncontact flat surface 7c of the slider contact the flat surface 6b of the slider fitting shaft when the fixed scroll 1 is fitted, the fixed scroll 1 can be fitted with the spring force being zero. The main shaft 5 rotates during the operation, thus causing the contract flat surface 7b to contact the flat surface 6a. Consequently, the eccentric amount r is properly attained and the flat plate 10 is deformed by $\epsilon^*$, whereby the spring force $F_S$ can be generated However, a minimum value exists in the eccentric amount r' after the slider 7 has moved as shown in FIG. 7. When the center of the slider 7 moves from that of the main shaft 5 in parallel to a line connecting the direction of $\theta$ in the eccentric direction during the operation, that is, when $\xi = r \cdot \sin\theta$, the eccentric amount has the minimum value $r_{min}$ and $$r_{min} = r\cos\theta$$

Therefore, the maximum value $\Delta r$ max of a decrease in the eccentric amount is given by $$r_{max} = r(1-\cos\theta) \tag{34}$$

Provided $\Delta r_{max} \geqq \xi^*$, the spring force in the static state can be made zero, that is, there exists $\xi$ capable of smoothly fitting the fixed scroll 1 without applying force thereto. $\Delta r < \epsilon^*$ may occur depending on $\theta$ obtained from Eq. (19) and the value of the proper eccentric amount determined by the spiral bodies of both scrolls. When $\Delta r < \epsilon^*$, the flat plate 10 is deformed by $(\epsilon^* - \Delta r_{max})$ even at $\xi = r \cdot \sin\theta$ in the static state and the fixed scroll 1 cannot be fitted smoothly because the spring force is not reduced to zero.

Embodiment 2

A description will subsequently be given of a second embodiment wherein the spring force is reduced to zero to ensure that the flat plate 10 is deformed in the static state. FIG. 8 illustrates the involvement of force acting on the principal part of a scroll compressor in the static state in the second embodiment of the present invention, wherein like reference characters designate like or corresponding parts of FIG. 2 and the description of them will be omitted. The overall configuration of the scroll compressor of FIG. 8 is similar to what is shown in FIG. 1. In FIG. 8, the groove end side 7d in the eccentric direction of the slider, that is, the recess 9 and the pedestal 11 do not orthogonally intersecting the contact flat surface 7b and the noncontact flat surface 7c but incline by $\alpha$ in such a way as to open to the side of the noncontact flat surface 7c. Therefore, the flat plate 10 naturally inclines by $\alpha$. As in the case of the first embodiment, however, the contact surface 6c of the slider fitting shaft in an arcuate form linearly contacts the flat plate 10 in the center of the recess 9 during the operation, that is, at the time the contact flat surface 7b of the slider contacts the flat surface 6a of the slider fitting shaft and that there exists the gap $\xi$ between the noncontact flat surface 7c of the slider and the flat surface 6b of the slider fitting shaft.

With the recess 9 and the pedestal 11 inclined by $\alpha$, relations equivalent to those in Eqs. (30), (31) are obtained from the force acting on the slider 7 in the static state and the orbiting scroll 2 as follows:

$$F_R = F_S \cos\alpha / \cos\theta \tag{35}$$

$$F_n = -F_R \sin(\theta+\alpha)/\cos\alpha = -F_S \sin(\theta+\alpha)/\cos\theta \tag{36}$$

Figure 9:
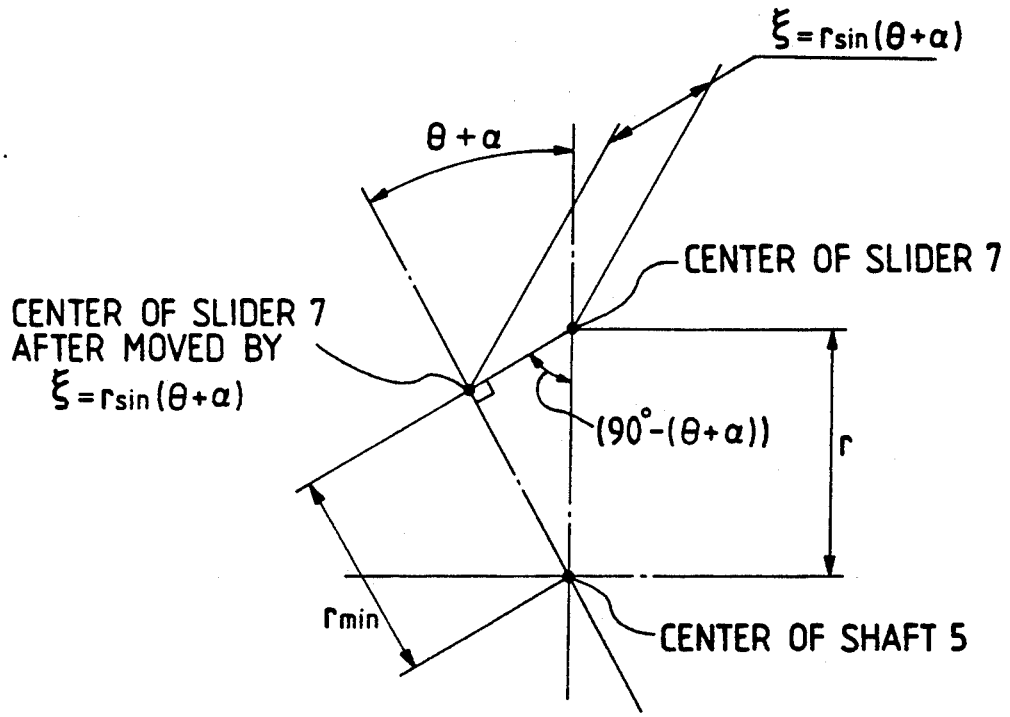
FIG. 9 is a diagram illustrating the variation of the eccentric amount of the slide which has made the parallel movement in the static state of the scroll compressor in the second embodiment of the present invention.
Figure 11:
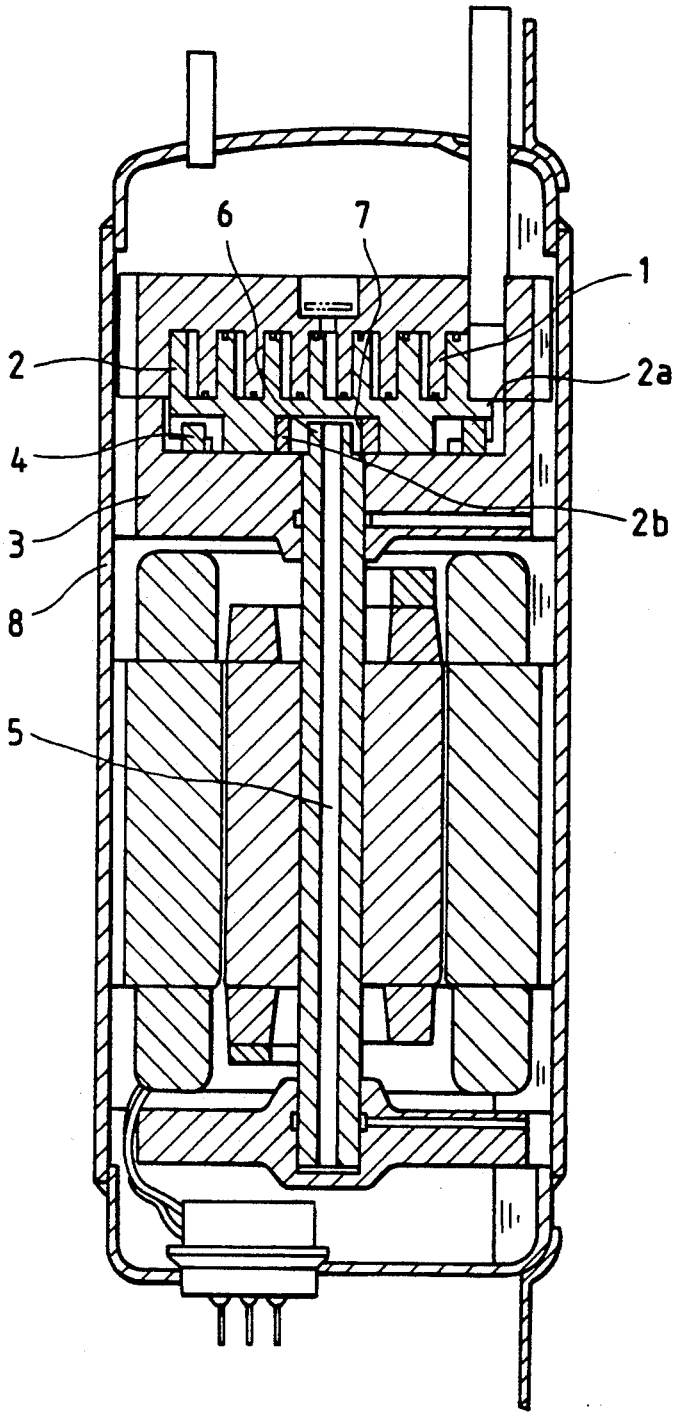
FIG. 11 (PRIOR ART)
FIG. 11 is a longitudinal sectional view of a conventional scroll compressor.
Figure 12:
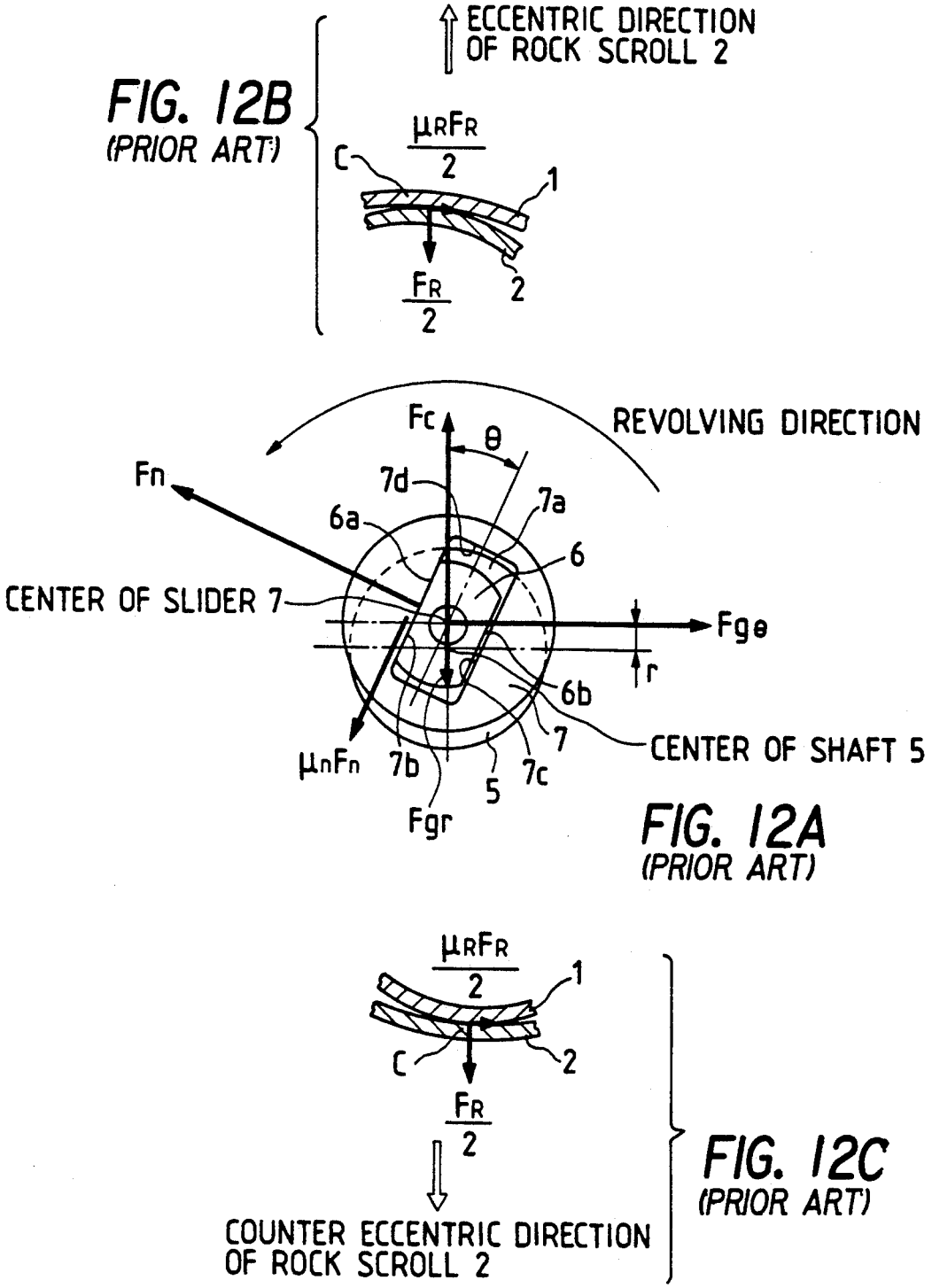
FIGS. 12A–12C are sectional views of the principal part of FIG. 11, illustrating the involvement of force acting on that part in operation.

Consequently, $F_n < 0$ like the first embodiment and the slider 7 moves in the direction perpendicular to the slide direction of the slider 7 and in parallel to the right-angled direction. As shown in FIG. 9, however, the eccentric amount r' after that movement is given by $$r' = [(r-\xi)^2 + 2r\xi\{1-\sin(\theta+\alpha)\}]^{\frac{1}{2}} \tag{37}$$

When $\xi = r\sin(\theta+\alpha)$, the eccentric amount is reduced to the minimum value $r_{min}$ $$ir_{min}=r\cos(\theta+\alpha)$$

Therefore, the maximum value $\Delta r_{max}$ equivalent to a decrease in the eccentric amount is given by $$\Delta r_{max}=r\{1-\cos(\theta+\alpha)\} \quad (38)$$

Consequently, the value of $\alpha$ can be adjusted to ensure $\Delta r_{max}=\epsilon$. In other words, the deformation of the flat plate 10, that is, the spring force can be reduced to zero in the static state. Provided the orbiting rock scroll 2 together with the slider 7 are moved in parallel so as to make the noncontact flat surface 7c of the slider contact the flat surface 6b of the slider fitting shaft, the fixed scroll may be fitted smoothly. Incidentally, the expressions obtained from the balance between the forces acting on the slider 7 and the orbiting scroll 2 during the operation vary with respect to those (8), (9) in the first embodiment when the recess 9 and the pedestal 11, together with the flat plate 10, are inclined by $\alpha$ as follows:

$$(F_C-F_{gr}-F_R)+F_S\cos(\theta+\alpha)-F_n\sin\theta(\pm\mu_nF_n\cos\theta)=0 \quad (8)'$$

$$(F_{g\theta}+\mu_RF_R)-F_S\sin(\theta+\alpha)-F_n\cos\theta\pm\mu_nF_n\sin\theta=0 \quad (9)'$$

From these equations, it is equally true in this case like the first embodiment to introduce such $\theta$ and $F_S$ as to make the slider 7 operate as desired by using the .maximum gas load $F_{g\theta n}$ under which the radial gap is always reduced to zero and the compression load $F_{g\theta max}$ to be relieved. As is obvious from (8)', (9)', the influence of $\alpha$ is relatively small and when $\alpha=0$ as in the case of the first embodiment and when the slide direction is inclined by $\alpha$, $\theta$ and $F_S$ are less variable, so that $\alpha$ can be used to adjust the fitting of the fixed scroll 1 without affecting the operating characteristics.

In the above embodiments, the recess 9 and the pedestal 11 have been provided on the groove end side in the eccentric direction of the slider and the arcuate contact surface 6c of the slider fitting shaft has been formed. However, the groove end side in the eccentric direction may be made arcuate and the recess 9 as well as the pedestal 11 may be provided on the side of the slider fitting shaft 6 as shown in FIG. 10.

Furthermore, in the cases of the first and second embodiments shown in FIGS. 2 and 8, moreover, if the key groove is formed on the side of the contact surface 6c of the slider fitting shaft, or, in the case of third embodiment shown in FIG. 10, on the groove end side 7d in the eccentric direction of the slider in order to let the key contact the flat plate 10 by inserting the arcuate key in between the groove and the flat plate 10, the same effect will be attainable. It is thus facilitated to control and adjust dimensions intended to obtain the predetermined deformation amount $\epsilon^*$ of the flat plate 10.

Lastly, it is noted that the same effects as those stated above can be achieved by making flat both the groove end side 7d in the eccentric direction of the slider and the contact surface 6c of the slider fitting shaft and inserting a belleville spring or a compression spring instead of providing the recess 9 and causing the spring force to be generated by deforming the flat plate 10 in the preceding embodiments.

The scroll compressor according to the present invention is constructed through the steps of inclining the slide direction of the slider toward the eccentric direction of the orbiting scroll by a predetermined amount in the rotational direction of the main shaft, providing the stage on the groove end side in the eccentric direction of the slider, inserting the elastic flat plate in the stage between the groove end side in the eccentric direction and the slider fitting shaft while both ends of the plate are supported, forming the slider fitting shaft in an arcuate configuration as long as the contact surface between the slide fitting shaft and the flat plate is concerned, and setting the distance between the center of the main shaft inserted in such a state that the flat plate stays notdeformed and that of the slider greater than the eccentric amount r determined by the fixed and orbiting scrolls and when the flat plate is deformed by a predetermined dimension, making the spiral bodies of both scrolls radially contact each other in the eccentric and counter-eccentric directions of the orbiting scroll, that is, making the distance therebetween equal to the predetermined eccentric amount r. Therefore, the spiral bodies of both the orbiting and fixed scrolls radially contact in the eccentric and counter-eccentric directions in such a state that both scrolls have properly been combined, thus causing the slider to slide until the flat plate is deformed by the predetermined dimension. In the state where the predetermined eccentric amount r has been attained, the deformed flat plate produces a spring force by which the orbiting scroll is pressed against the fixed scroll, whereby while the spiral bodies of both scrolls contact each other (the contact force $F_R>0$) in the eccentric and counter-eccentric directions during the normal gas compression, that is, while the radial gap remains at zero at all times, the compressive action free from leakage is performed. When the compression load $F_{g\theta}$ increases in the direction perpendicular to the eccentric direction as the pressure in the compression chamber increases at the time of liquid compression, the force causing the slider to slide in the direction in which the eccentric amount decreases tends to grow, so that the slider is slid in the direction in which the eccentric amount decreases. As a result, the radial gap is produced between both scrolls, so that the pressure can be relieved. As a result, the spiral bodies of both scrolls are prevented from snapping to ensure that a highly efficient, reliable scroll compressor is obtained.

Furthermore, a scroll compressor according to the present invention is excellent in workability to ensure that the fixed scroll is fitted in such a state that the spring force remains at zero by inclining the groove end side in the eccentric direction of the slider toward the noncontact flat surface side by the predetermined amount without causing the groove end side to orthogonally intersect the contact flat surface and the noncontact flat surface of the slider.

What is claimed is:

1. A scroll compressor comprising:

a pair of a fixed scroll and an orbiting scroll for forming a compression chamber, spiral bodies of both scrolls being respectively projected from a base plate, both said scrolls being eccentric with each other by a phase difference of 180 degrees;

an orbiting bearing provided on a counter-compression chamber side of said orbiting scroll;

a slider fitted to a slider fitting shaft at one end of a main shaft in such a way that said slider is slidable within a surface perpendicular to an axis of said main shaft but not rotatable therearound, said slider being fitted in said orbiting bearing, wherein a sliding direction of said slider is inclined toward an eccentric direction of said orbiting scroll by a predetermined amount in a rotational direction around said main shaft;

a recess provided on a groove end side in said eccentric direction of said slider; and an elastic member inserted in said recess between the groove end side in said eccentric direction and said slider fitting shaft;

wherein said slider fitting shaft is formed in an arcuate configuration as long as the contact surface between said elastic member and said slider fitting shaft is concerned, and wherein spiral bodies of said fixed scroll and said orbiting scroll both are made to radially contact each other in said eccentric and counter-eccentric directions of said orbiting scroll after said elastic member is deformed by a predetermined amount.

2. A scroll compressor claimed in claim 1, wherein said groove end side in said eccentric direction of said slider inclines by a predetermined amount in said rotational direction around said main shaft.

3. A scroll compressor as claimed in claim 1, wherein a key groove is formed on a side of said contact surface of said slider fitting shaft in order to let contact said elastic member by inserting an arcuate key in between said key groove and said elastic member.

4. A scroll compressor as claimed in claim 1, wherein said elastic member is a flat plate means.

5. A scroll compressor comprising:

a pair of a fixed scroll and an orbiting scroll for forming a compression chamber, spiral bodies of both scrolls being respectively projected from a base plate, both said scrolls being eccentric with each other by a phase difference of 180 degrees;

an orbiting bearing provided on a counter-compression chamber side of said orbiting scroll;

a slider fitted to a slider fitting shaft at one end of a main shaft in such a way that said slider is slidable within a surface perpendicular to an axis of said main shaft but not rotatable therearound, said slider being fitted in said orbiting bearing, wherein a sliding direction of said slider is inclined toward an eccentric direction of said orbiting scroll by a predetermined amount in a rotational direction around said main shaft;

a recess provided on an end of said slider fitting shaft; and an elastic member inserted in said recess between the groove end side in said eccentric direction and said slider fitting shaft;

wherein a groove end side in said eccentric direction of said slider is formed in an arcuate configuration as long as a contact surface between said elastic member and said slider fitting shaft is concerned, and wherein spiral bodies of said fixed scroll and said orbiting scroll both are made to radially contact each other in said eccentric and counter-eccentric directions of said orbiting scroll after said elastic member is deformed by a predetermined amount.

6. A scroll compressor as claimed in claim 5, wherein said end of said slider fitting shaft inclines by a predetermined amount in said rotational direction around said main shaft.

7. A scroll compressor as claimed in claim 5, wherein a key groove is formed on a groove end side in the direction of said slider in order to let contact said elastic member by inserting an arcuate key in between said key groove and said elastic member.

8. A scroll compressor as claimed in claim 5, wherein said elastic member is a flat plate means.

* * * * *